United States Patent [19]

Zimmer

[11] 3,986,451

[45] Oct. 19, 1976

[54] SCREEN HOLDER MECHANISM FOR ROTARY SCREENS

[76] Inventor: Peter Zimmer, Untere Sparchen 54, 6330 Kufstein, Austria

[22] Filed: Aug. 19, 1974

[21] Appl. No.: 498,539

Related U.S. Application Data

[63] Continuation-in-part of Ser. Nos. 328,258, Jan. 31, 1973, abandoned, and Ser. No. 333,800, Feb. 20, 1973, abandoned.

[30] Foreign Application Priority Data

Feb. 9, 1972 Austria ..... 1043/72
Feb. 21, 1972 Austria ..... 1369/72

[52] U.S. Cl. ..... 101/127.1; 101/128.1
[51] Int. Cl.[2] ..... B41F 15/38
[58] Field of Search ..... 101/116, 115, 127.1, 101/128.1

[56] References Cited

UNITED STATES PATENTS

| | | | |
|---|---|---|---|
| 3,565,001 | 2/1971 | Zimmer | 101/116 |
| 3,565,002 | 2/1971 | Boehm | 101/116 |
| 3,837,277 | 9/1974 | Jaffa | 101/127.1 |

*Primary Examiner*—Edgar S. Burr
*Assistant Examiner*—R. E. Suter
*Attorney, Agent, or Firm*—Wenderoth, Lind & Ponack

[57] ABSTRACT

A screen holder mechanism tensions a rotary screen in the axial direction thereof. Novel tensioning and retaining means are positioned between a screen holder and each end of the screen to position the screen at a predetermined vertical position. The tensioning and retaining means provides that the resultant of the axial tension applied to the screen coincides with the longitudinal axis of the screen, thereby avoiding dynamic stress on the screen.

9 Claims, 3 Drawing Figures

SCREEN HOLDER MECHANISM FOR ROTARY SCREENS

This application is a continuation-in-part application of copending applications Ser. No. 328,258 filed Jan. 31, 1973, now abandoned and Ser. No. 333,800, filed Feb. 20, 1973, now abandoned.

BACKGROUND OF THE INVENTION

The present invention is directed to an improved screen holder mechanism for rotary screens in a rotary screen printing machine.

Many types of screen holder mechanisms are known. The function of such mechanisms is to not only axially and radially or guide a rotary screen in a desired printing position in a rotary screen printing machine, but also to axially tension the rotary screen. Such screen holder mechanisms are usually provided with mounting arrangements which are adjustable so that they may be used for supporting screens of various different diameters. The screen holder mechanisms support the rotary screens in the printing machine in a position whereat the screens may be rotated. The screen holder mechanisms, due to the fact that the rotary screens are very thin walled, are movable in a direction axially of the screen, and thereby impart axial tension to the screen. Such mechanisms normally include two screen holders, one at each end of the screen. One or both of these screen holders are movable to provide the axial tensioning of the screen.

Among the various known screen holder mechanisms, most of them are extremely complicated and result in the necessity for considerable amounts of work to mount a screen in or remove a screen from the mechanism.

To overcome this disadvantage, it has become known to provide a screen holder mechanism which is completely accessible from above, i.e. such that the rotary screen may be easily mounted in or removed from the mechanism at any angular position of the screen.

One such arrangement is shown in U.S. Pat. No. 3,565,002 wherein the screen holder mechanism is completely accessible from above and wherein the rotary screen may be readily mounted in or removed from the mechanism. However, this mechanism has the disadvantage that during operation the rotary screen has an uncontrolled tendency to lift upwardly, thereby seriously affecting the quality of printing. This is due to the fact that the weight of the screen is normally insufficient to insure its continuous operative position, and the screen therefore tends to lift upwardly.

A further known screen holder mechanism which is completely accessible from above overcomes this disadvantage. Specifically, the mechanism described in U.S. Pat. No. 3,565,001 discloses a screen holder mechanism which is completely open from above and wherein the screen is prevented from uncontrolled lifting by a plurality of annular recesses and bosses arranged around each end of the screen. However, this arrangement, although preventing uncontrolled lifting of the screen, has the further very distinct disadvantage.

SUMMARY OF THE INVENTION

Accordingly, it is a primary object of the present invention to provide a screen holder mechanism which has the advantages of the above discussed prior art mechanisms, but yet which overcomes the above discussed disadvantages.

It is a further object of the present invention to provide such a screen holder mechanism which prevents uncontrolled upward lifting of a rotary screen during operation.

It is a still further object of the present invention to provide such a mechanism which axially tensions the screen as well as radially and axially guides the screen, such that the resultant of the axial tension substantially coincides with the longitudinal axis of the screen, and therefore no dynamic stress is imparted to the screen as a result of the axial tensioning.

The above objects are achieved in accordance with the present invention by providing a screen holder mechanism which is selectively movable in a direction axially of the screen.

Tensioning and retaining means are mounted between each end of the screen and an opposed surface of the screen holder mechanism. The tensioning and retaining means resiliently tension the screen axially, and additionally position the screen in a vertical direction during normal operation.

In a preferred embodiment of the invention, each end of the screen has rotatably mounted therearound a thrust plate having V-shaped grooves therein. Bearings are interposed between the thrust plate and the end of the screen such that when the screen is rotated, the thrust plate remains stationary. On an opposed surface of the screen holder mechanism there is formed a bore in which is mounted a tension pin urged outwardly from the bore by means of a compression spring. The tension pin has at the end thereof a conical tip sharper than the cross-sectional contour of the V-shaped groove in the thrust plate. The screen holder mechanism is moved axially of the screen with the tension pin engaging the opposed V-shaped groove. This movement and the force of the compression spring cause the tension pin to engage in the V-shape groove and force the thrust plate axially outwardly, thereby axially tensioning the screen. The engagement of the tension pin within the groove vertically positions the screen.

BRIEF DESCRIPTION OF THE DRAWINGS

Other objects and features of the invention will be made apparent from the following detailed description taken with the accompanying drawings wherein.

DETAILED DESCRIPTION OF THE INVENTION

Figure 1:
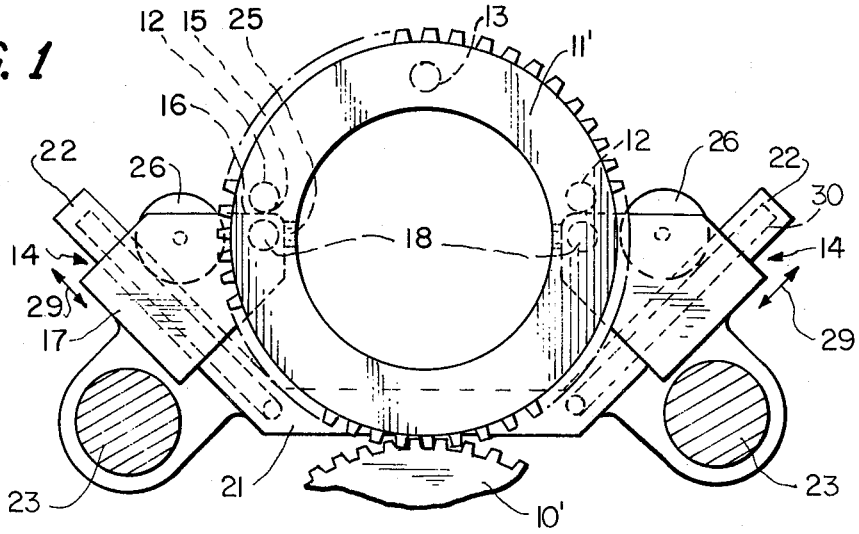
FIG. 1 is an end elevation view of one embodiment of the screen holder mechanism in accordance with the present invention.

For purposes of clarity, in the drawings only one end of a rotary screen 9 and the respective screen holder mechanism thereof is shown, since the opposite end of such devices are identical.

With reference to the drawings, a printing machine frame (not shown) includes means (not shown) to move a web of material, such as a fabric, in a horizontal direction beneath and in contact with a screen 9. Support pillars or tubes 23 are mounted by known means to the printing machine frame to extend transversally to the direction of movement of the material and parallel to the longitudinal axis of screen 9.

Movably mounted on tubes 23 at each transverse end of the printing machine, i.e., adjacent each end of screen 9, is a screen holder mechanism 14. This mechanism includes a base 21 movably mounted on tubes 23. Diverging upwardly and outwardly from base 21 are support bars 22, each supporting a slide 17. Slides 17 are mounted for movement along the respective support bars 22 by suitable means, such as threaded spindles 30. The connection between slides 17 and the respective spindles 30 are not shown, but would be readily understandable to one of ordinary skill in the art. For instance, each spindle 30 could have a nut attached thereto which would engage with an arm of the respective slide 17 which would extend through a slot in the respective support bar 22. It will be understood thereby that slides 17 may be synchronously moved upwardly and downwardly along the respective support bars 22 in the directions indicated by the double headed arrows 29 in FIG. 1.

The rotary screen 9 is a conventional such element, such as a perforated cylindrical rotary screen having a longitudinal axis extending transverse to the direction of movement of the material. To each opposite end of screen 9 is attached in a known manner a screen head or end 8. To at least one end 8 of screen 9 is rigidly fixed a screen gear 10 engageable in a known manner with a printing machine drive gear 10' when the screen is in position. The support and arrangement of drive gear 10' forms no portion of the present invention and could be achieved in various known ways to impart rotation to screen 9 in a suitable and desired direction.

Revolvably mounted around each of the ends 8 of the screen 9 is a combined bearing and thrust plate arrangement 11. In the illustrated example, element 11 includes a thrust plate 11' which is loosely or rotatably mounted about end 8 and which faces gear 10. Gear 10 forms the other plate or race of arrangement 11 for bearings interposed between gear 10 and plate 11'. Accordingly, upon rotation of drive gear 10', gear 10 will rotate and thus cause screen 9 to rotate. However, plate 11' will remain stationary due to the bearings interposed between plate 11' and gear 10.

Fixed on the inner surface of each plate 11' are screen support pins 12 which rest on upper faces 16 of slides 17 when the screen is placed in its operative position. Also if desired, lifting means such as pins 13 may be provided on plates 11 to facilitate the lifting and lowering, i.e. the removal and placement, of screen 9 within the support mechanism. It is a feature of the present invention that the screen be insertable in and removable from the screen holder mechanism at any angular position of the screen.

Fixed on the inner lateral sides of each support mechanism 14 are guide elements, such as wheels 26, which may be adjusted to contact surface 28 of screen ends 8. It will be apparent thereby that wheels 26 of each mechanism 14 guide and position the respective end 8 of the screen 9 in the lateral direction as viewed in FIGS. 1 and 2.

Interposed between each slide 17 and the respective facing surface of plate 11' is provided the novel tensioning and retaining structure of the present invention. Specifically, in the illustrated embodiment, on the inner surface of plate 11' are formed V-shaped grooves 25. These grooves should extend parallel with each other, and parallel to the direction of movement of the material. In a particularly advantageous embodiment, and as illustrated in FIG. 1 of the drawings, grooves 25 extend horizontally in a horizontal plane passing through the longitudinal axis of screen 9, i.e., grooves 25 extend horizontally and radially of the longitudinal axis of screen 9.

In the outer lateral face of each slide 17 is formed a bore 19 which has positioned therein a compression spring 20 and a tension pin 18. Tension pin 18 has at the outer end thereof a conical tip somewhat sharper than the cross-sectional contour of V-shaped groove 25. Each conical tip 31 is adapted to be received in the respective opposed groove 25 during the printing operation.

It is believed that the operation of the device of the present invention will be apparent from the above description. However, such operation will be summarized below.

Figure 2:
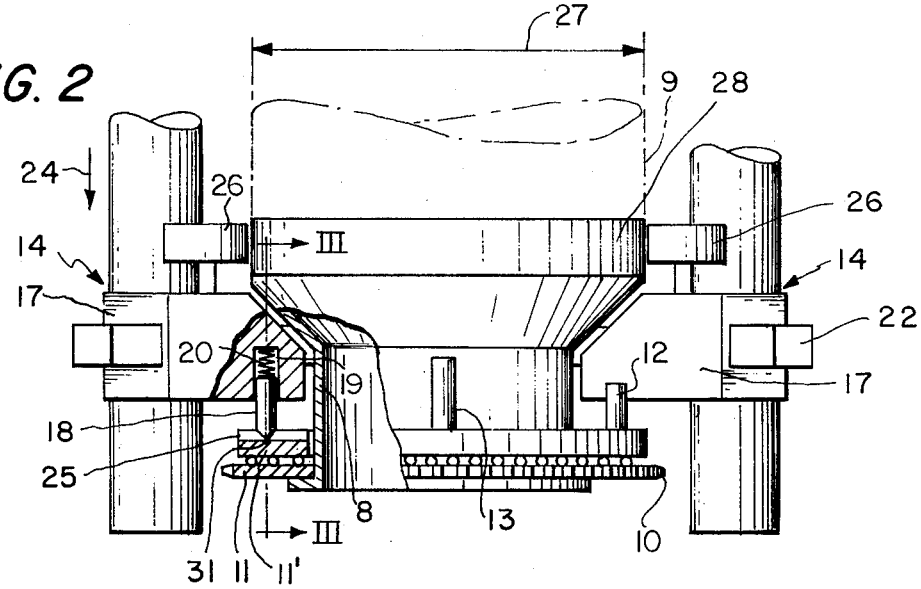
FIG. 2 is a plan view of the mechanism illustrated in FIG. 1.
Figure 3:
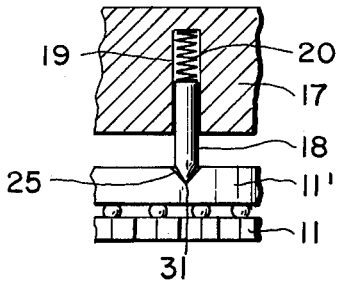
FIG. 3 is a partial cross-sectional view taken along the lines III—III of FIG. 2.

The screen 9 having opposite ends 8 and plates 11' thereon is lowered into a position such that pins 12 rest on surfaces 16 and such that drive gear 10' is in meshing engagement with gear 10. Depending upon the diameter of screen 9, slides 17 are synchronously moved upwardly or downwardly in the direction 29 such that guide wheels 26 are in contact with surface 28. This stabilizes the position of screen 9 laterally as seen in FIG. 1 of the drawings and prevents movement of the screen in such direction. Pins 18 are then aligned with their respective grooves 25, and at least one of the mechanisms 14 is moved longitudinally along tubes 23. For instance, as shown in FIG. 2, the illustrated mechanism 14 is moved in the direction 24. The movement of the support mechanisms 14 in the direction 24 may be carried out in any suitable known manner. The actual distance of such movement is slight, for instance, only a few millimeters, and need be sufficient only to place tension on springs 20 by forcing pins 18 against the bottoms of their respective grooves 25. By this operation, screen 9 is tensioned in opposite longitudinal directions thereof. Specifically, each slide 17 imparts tension to pins 18 through springs 20. This tension is transferred to plates 11' which thereby tension or stretch the screen 9 in opposite longitudinal directions thereof. The pins 18 are preferably positioned symmetrically to the longitudinal axis of the screen, thereby insuring that the resultant of the axial stress imparted to the screen will substantially coincide with the longitudinal axis thereof, thereby avoiding dynamic stress on the screen due to the axial tensioning thereof.

As stated above, the lateral or sideways stabilization of screen 9 is achieved by guide wheels 26. However, in accordance with the present invention, uncontrolled vertical lifting of the screen 9 is prevented by the tensioned engagement of pins 18 in respective grooves 25. Thereby, the vertical placement of screen 9 is stabilized to insure proper contact of the screen with the material to be printed.

An additional advantageous feature of the illustrated embodiment of the present invention is that by inclining support bars 22 at an angle of 45° to the horizontal, it is possible by adjusting slides 17 in the direction of arrows 29 to accommodate screens of differing diameters, without the need for raising or lowering mechanisms 14. More specifically, tubes 23 and mechanisms 14 need not be raised or lowered when exchanging a screen of one diameter for a screen of a differing diameter, if the angle of inclination of support bars 22 is exactly 45°. It of course is to be understood that tubes 23 are provided in a normal manner with slight vertical adjusting means. However, in accordance with the present invention, this adjustment means (not shown) is necessary only to accommodate differing thickness of material and differing contact pressure between the screens and material.

It is of course to be understood that the scope of the present invention is not limited to the specific structural arrangements illustrated. That is, it is intended to be within the scope of the present invention that pin 18, bore 19 and spring 20 could be located in plate 11', and groove 25 could be located in slide 17. Furthermore, the resiliency supplied by spring 20 in the illustrated embodiment could be supplied by other means, for instance a fluid pressure source. The important feature is that there be located between the mechanisms 14 and the ends of the screen means for axially but resiliently tensioning the screen.

Even still further, it is to be understood that the overall screen holder mechanism need not be the mechanism specifically illustrated in the drawings, but rather may be other known types of screen holder mechanisms, as long as the operation and functioning of the tensioning and retaining structure of the present invention is not altered.

What is claimed is:

1. In a screen holder mechanism for supporting and axially tensioning a rotary screen in a rotary screen printing machine, said rotary screen being of the type having axially opposite integral end pieces and a drive gear integral with at least one of said end pieces, said mechanism being of the type including a pair of screen holders at least one of which is mounted to move with respect to said rotary screen printing machine in a direction parallel to the longitudinal axis of said rotary screen to impart axial tension to said end pieces and said rotary screen, said mechanism further being completely open at the top thereof wherein said rotary screen is insertable and removable at any angular position thereof from the top of said mechanism with no dismantling operation other than relieving said axial tension on said rotary screen; the improvement wherein said mechanism further comprises:

means for supporting said screen and for imparting resilient axial tension thereto, said supporting and tension imparting means comprising thrust plate means rotatably mounted on each of said end pieces for transferring said axial tension from said screen holders to said end pieces; and means resiliently positioned between each of said screen holders and the respective of the thrust plate means for transfer of said axial tension therebetween, and for positioning said screen at a predetermined vertical position.

2. The improvement claimed in claim 1, wherein each of said screen holders comprises a base having opposite ends and being movable in said direction parallel to said longitudinal axis of said rotary screen; a pair of slides, each of said slides mounted on one of said opposite ends of said base for adjustable movement in the direction extending upwardly and outwardly from said opposite end of said base in a plane perpendicular to said longitudinal axis of said rotary screen; and centering means positioned on each of said slides separate from said tensioning and retaining means for contacting opposite sides of the periphery of said end pieces and maintaining the longitudinal axis of said rotary screen in a position equally spaced between said slides.

3. The improvement claimed in claim 2, wherein the directions of movement of each of said slides are at angles of 45° to the horizontal.

4. The improvement claimed in claim 2, wherein each of said slides has an upper face; and further comprising stop pins fixed to said thrust plate means and resting on said upper faces of said slides.

5. The improvement claimed in claim 2, wherein said thrust plate means have therein a pair of grooves, and said transfer and positioning means comprise a pair of resiliently mounted pins engaging in said grooves.

6. The improvement claimed in claim 5, wherein said pair of pins associated with each of said screen holders are symmetrically positioned on opposite sides of said longitudinal axis of said screen and extend parallel thereto.

7. The improvement claimed in claim 5, wherein said grooves are radially formed on opposite sides of the respective of said thrust plate means; and one of said pair of pins are resiliently mounted in each of said slides in a position to engage with the respective said groove in said thrust plate means upon movement of said base, thereby positioning said rotary screen in said predetermined vertical position.

8. The improvement claimed in claim 7, wherein each of said pins has a conical tip, and each of said grooves has a V-shaped profile.

9. The improvement claimed in claim 8, wherein the conical tip of each of said pins has an acute angle smaller than the angle of the profile of said grooves.

* * * * *